United States Patent [19]

Christophel

[11] 4,169,457

[45] Oct. 2, 1979

[54] THERMOSTATICALLY REGULATED SPACE HEATERS FOR BURNING WOOD, COAL AND THE LIKE

[75] Inventor: Reuben L. Christophel, Harrisonburg, Va.

[73] Assignee: Shenandoah Manufacturing Co., Inc., Harrisonburg, Va.

[21] Appl. No.: 809,622

[22] Filed: Jun. 23, 1977

Related U.S. Application Data

[63] Continuation of Ser. No. 615,711, Sep. 22, 1975, abandoned.

[51] Int. Cl. ..... F24b 3/00

[52] U.S. Cl. ..... 126/65; 126/172; 126/290

[58] Field of Search ..... 126/58, 65, 155, 158, 126/171, 172, 190, 197, 200, 245, 285 R, 290

[56] References Cited

U.S. PATENT DOCUMENTS

| | | | |
|---|---|---|---|
| 926,335 | 6/1909 | Katzinger | 126/171 |
| 1,504,661 | 8/1924 | Wertheim et al. | 126/190 |
| 1,872,020 | 8/1932 | Taylor | 126/190 |
| 2,133,421 | 10/1938 | Brown | 126/65 |
| 2,212,298 | 8/1940 | Martin et al. | 126/285 R |
| 2,384,596 | 9/1945 | Burke et al. | 126/190 |
| 2,533,674 | 12/1950 | Locke | 126/197 |
| 2,797,874 | 7/1957 | Harding | 126/65 |
| 3,939,817 | 2/1976 | Nuss | 126/190 |

FOREIGN PATENT DOCUMENTS

| | | | |
|---|---|---|---|
| 847084 | 10/1939 | France | 126/190 |

*Primary Examiner*—Martin P. Schwadron
*Assistant Examiner*—G. L. Walton
*Attorney, Agent, or Firm*—Mason, Fenwick & Lawrence

[57] ABSTRACT

A coal or wood-burning, thermostatically-operated space heater is shown and described. The heater includes a single thermostatically-operated draft control damper for controlling the supply of primary and secondary air to the fire chamber to avoid extreme temperature fluctuations and thus provide more even heating, to avoid excessive fuel consumption, and maximize burning efficiency. A movable grate assembly provides a simple, efficient mechanism for stirring the fuel and clearing the fire of ashes and spent fuel.

10 Claims, 7 Drawing Figures

Fig-1
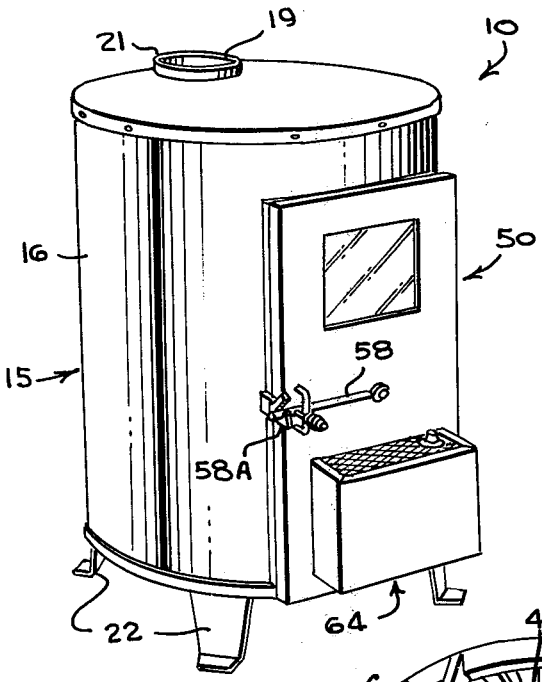
Fig-7
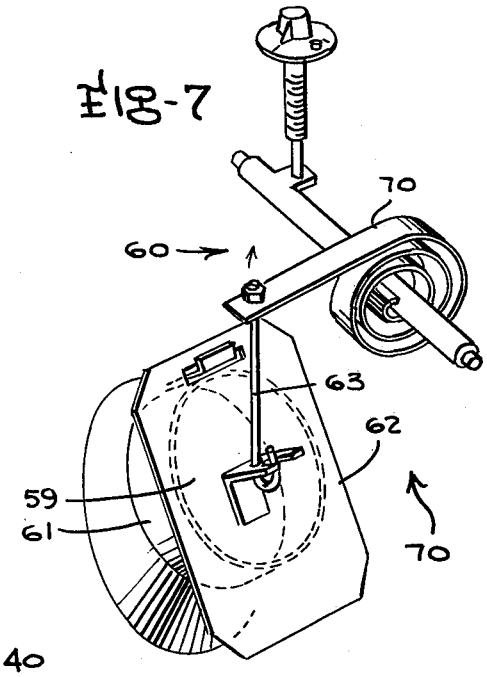
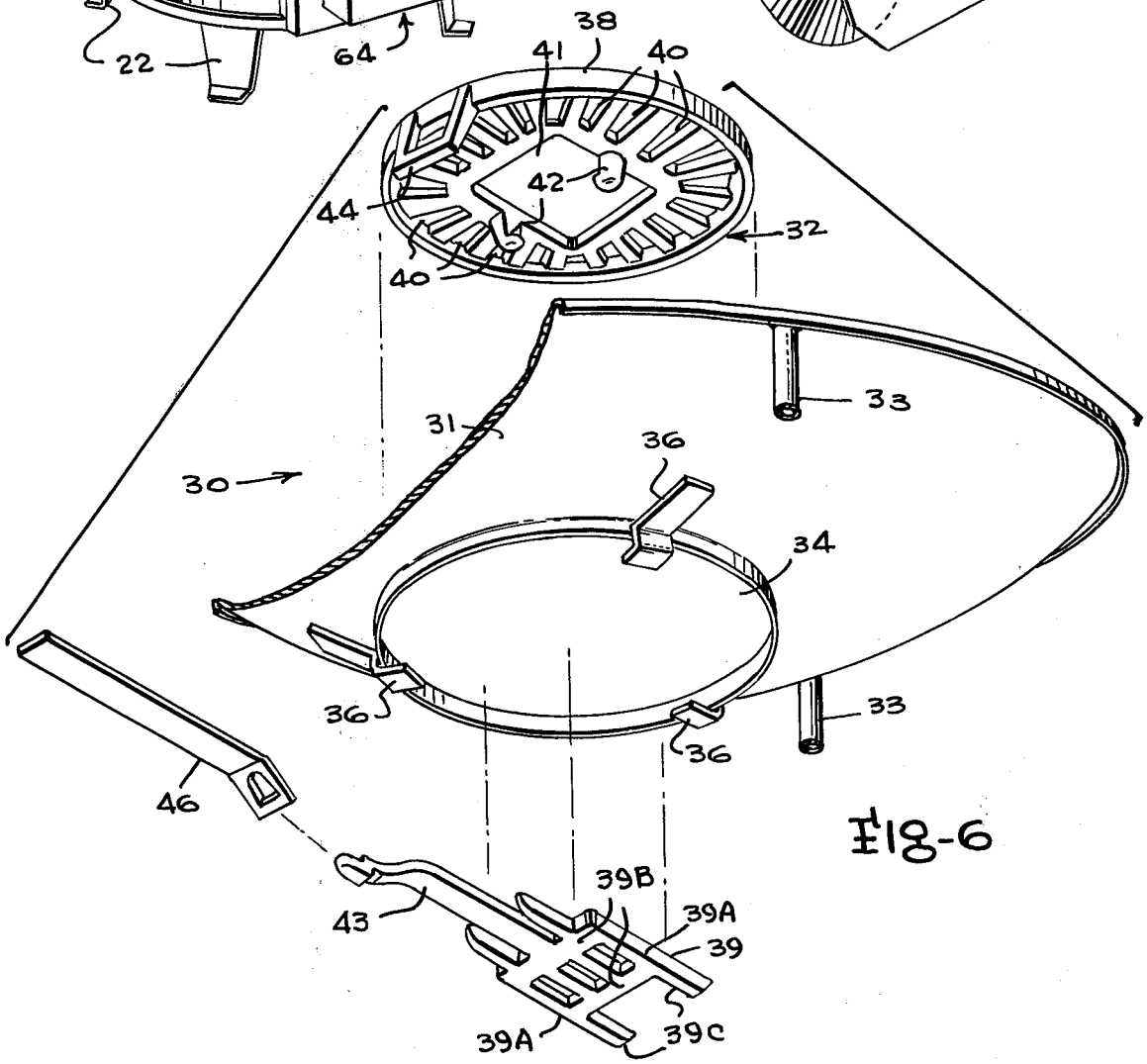
Fig-6

THERMOSTATICALLY REGULATED SPACE HEATERS FOR BURNING WOOD, COAL AND THE LIKE

This is a continuation of application Ser. No. 615,711, filed Sept. 22, 1975, now abandoned.

BACKGROUND AND OBJECTS OF THE INVENTION

The present invention relates to space heaters, and more particularly to a wood-burning or coal-burning, thermostatically-controlled space heater. The particular wood-burning or coal-burning space heater herein disclosed includes a heater casing having a single door which is sealed against air inflow about its perimeter and provides access to the interior fire chamber so that fuel can be added and ashes and spent fuel removed. Mounted upon the airtight door is a thermostatically-operated damper for controlling the draft inlet to achieve supply of oxygen both under and over the grate supporting the fuel. As a result of this construction, the draft may be held to a minimum, to prolong the burning of the fuel, or increased to provide a faster burning, hotter fire.

An object of the present invention is the provision of a novel wood-burning or coal-burning space heater employing a thermostatic control to regulate a single draft inlet to control both primary and secondary air supply to the fire chamber and a novel grate structure for supporting the fuel capable of reciprocating and rotary movement to agitate the material supported on the grate.

Another object of the present invention is the provision of a novel wood-burning or coal-burning sheet metal space heater having a fire-brick lined grate area and an unlined upper portion to provide desirable heat retention and fast heating characteristics.

A further object of the present invention is the provision of a novel wood-burning or coal-burning space heater employing a single door to house temperature control apparatus and provide interior access for purposes of both adding fuel and removing ashes.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a perspective view of a wood-burning or coal-burning space heater embodying the present invention;

FIG. 6 is an exploded perspective view of the grate assembly; and

FIG. 7 is a fragmentary exploded perspective view of the damper assembly.

DETAILED DESCRIPTION OF A PREFERRED EMBODIMENT

Figure 3:
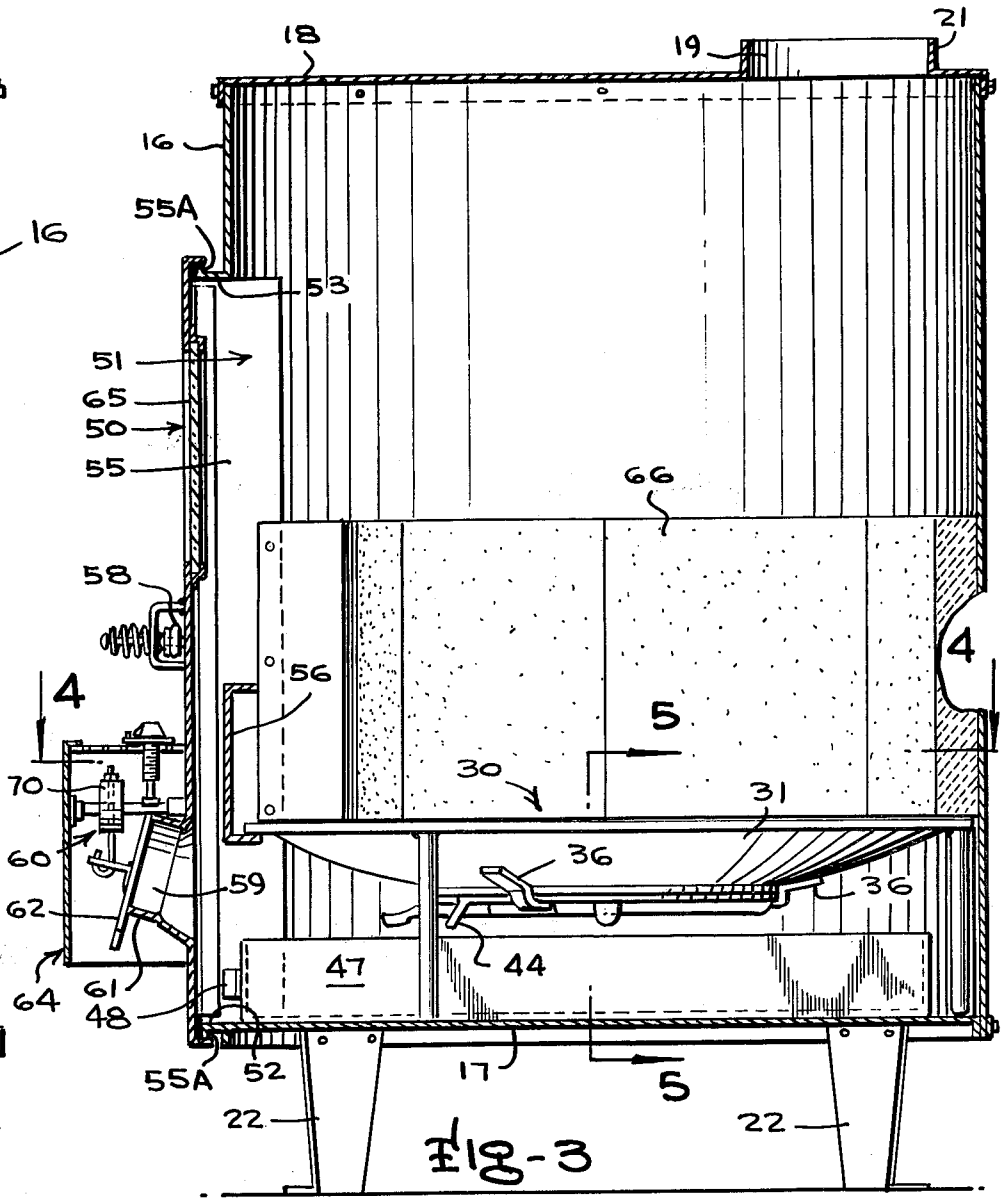
FIG. 3 is a vertical section view of the heater, taken along the line 3—3 of FIG. 2.
Figure 2:
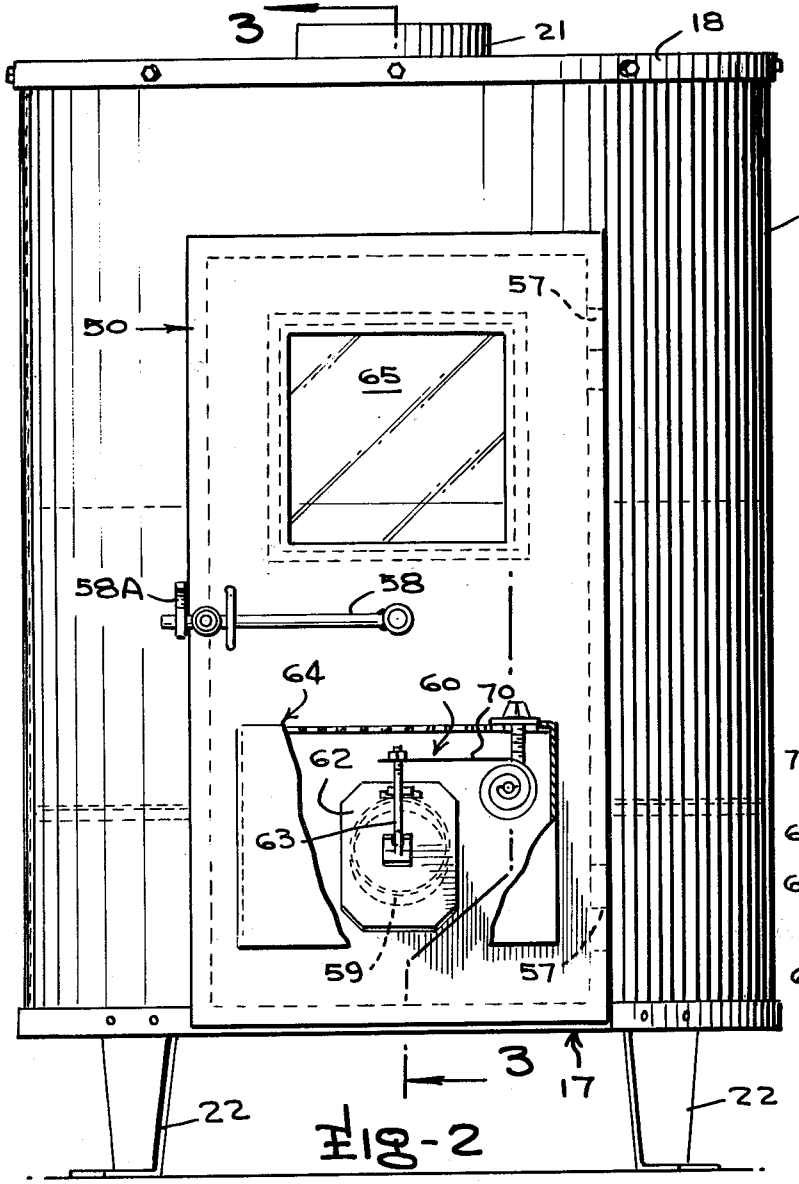
FIG. 2 is a front elevation of the space heater, with parts broken away.
Figure 4:
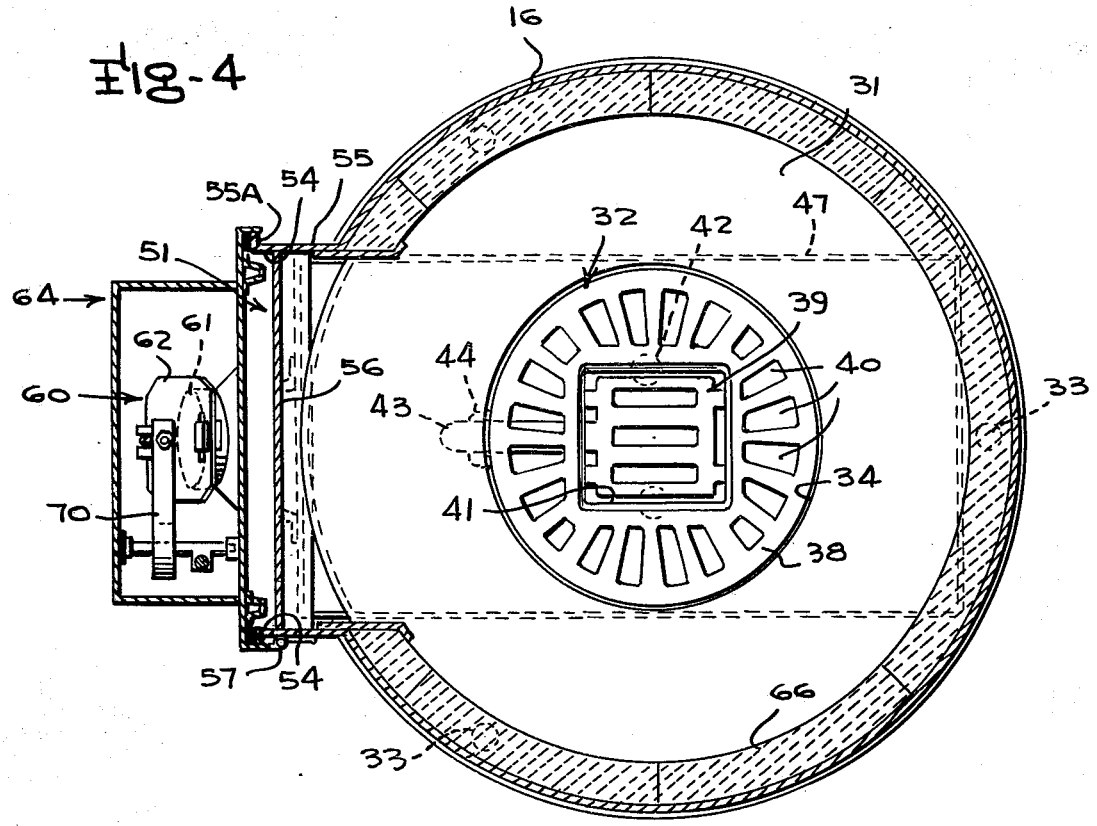
FIG. 4 is a horizontal section view taken along the line 4—4 of FIG. 3.
Figure 5:
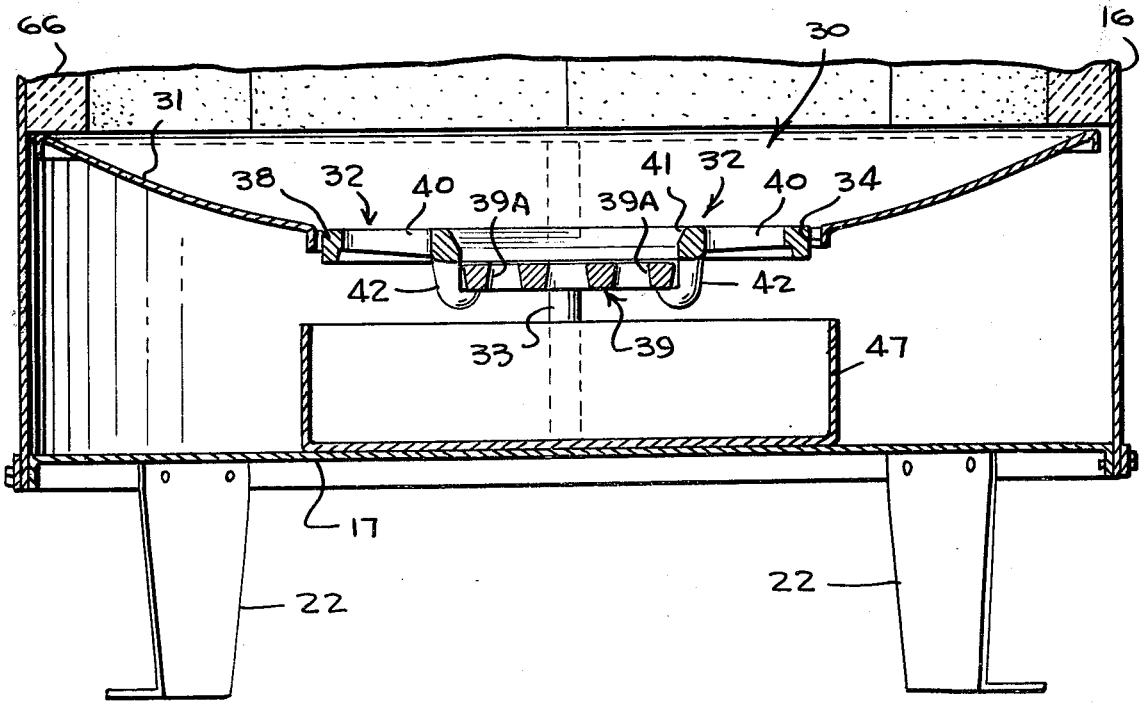
FIG. 5 is a fragmentary horizontal section view of the grate assembly taken along the line 5—5 of FIG. 3.

Referring to the drawings wherein like reference characters designate corresponding parts throughout the several figures, the thermostatically-controlled coal or wood-burning space heater of the present invention is indicated generally by reference character 10, and comprises a cylindrical heater casing, a grate assembly 30, an airtight door assembly 50, and a damper 60 automatically operably by a thermostat 70.

The heater casing 15 in the illustrated embodiment is of a cylindrical configuration although other enclosure shapes can be used. The depicted cylindrical casing 15 comprises a sheet metal outer cylindrical jacket or shell 16 arranged concentric with a vertical axis, a circular bottom wall or end plate 17, a circular top wall or end plate 18, and a plurality of downwardly depending legs 22. Bottom wall 17 and top wall 18 are both secured tightly against cylindrical jacket 16, and the top wall 18 additionally includes an exhaust passage 19 therethrough bounded by a flange or collar 21 providing a means defining a smoke outlet for attaching a chimney stack to casing 15 to conduct exhaust gases and ash fly through exhaust passage 19 and away from the heater. Alternatively, the smoke outlet may be located in upper rear portion of the jacket 16 rather than in the top wall 18. The heater casing and its contents are supported by a plurality of downwardly depending legs 22 which in the illustrated embodiment are formed of truncated triangular metal plates having bottom flanges forming feet at their lower ends.

A grate assembly 30 is positioned within the lower portion of jacket 16 defining an upper fire chamber above the grate and an ash chamber below the grate. The grate assembly 30 includes an outer annular fuel support platform 31, a central dump grate assembly 32, and downwardly depending legs 33. The outer perimeter of the fuel support platform 31 is shaped to conform to the horizontal cross sectional shape of the jacket 16 and has sides sloping downward and inward from its outer perimeter to a center opening 34 for the dump grate 32. Retainer brackets 36, fixedly attached to the underside of fuel support platform 31 and located at the edge of opening 34, support the central dump grate 32 under and within opening 34. Downwardly extending legs 33 at the outer edge of the platform 31 support the fuel and grate assembly 30 at a predetermined height above and within the interior of the jacket 16.

The central dump grate assembly 32 comprises two grate sections formed by an outer grate 38 and an inner or center grate 39. In the embodiment shown, opening 34 in the fuel support platform 31 is of a round shape and the outer grate 38 is also round and is of a diameter to approximate the diameter of and fit movably within opening 34. The outer grate 38 is provided with numerous smaller holes 40 to allow for the passage of air and ashes therethrough and has a single larger central opening 41 which is in the shape of a square with rounded corners in the illustrated embodiment. Angle brackets 42 extend downwardly from outer grate 38 at opposite sides of center opening 41 to slidably support inner grate 39 beneath opening 41. The inner or center grate 39 is a cast member having a pair of parallel side bar portions 39A extending in one direction and a plurality of parallel cross member portions 39B extending between and joining the pair of parallel bar portions collectively defining a square sized to correspond to and lie below opening 41. The side bars 39A include extension legs 39C projecting beyond the endmost cross member 39B at one end and a handle 43 extends from the other end. The spacing between bar portions 39A and cross member portions 39B is selected to be large enough to permit the passage of spend fuel downwardly into the ash chamber. A U-shaped bracket 44 is carried by and depends from outer grate 38 through which the handle passes to provide support for handle 43 while accommodating longitudinal reciprocation of movement of the handle. Handle 43 is adapted to releasably couple with a removable handle extension 46 of sufficient length to extend at least to the edge of the platform 31. When door 50 is open, handle extension 46 may be attached to handle 43 to reciprocate the inner center grate 39 back and forth.

Handle extension 46 is capable of two types of movement. First, a radial motion applied to handle extension 46 when coupled with handle 43 will move inner grate 39 back and forth longitudinally with respect to outer grate 38 along the slide axis permitted by the side angle brackets 43. This will clear the central dump grate 32 of ash and small pieces of spent fuel. Second, handle extension 46 can be moved angularly, to rotate the entire central dump grate 32, which includes both outer grate 38 and inner grate 39 about the center axis of grate 38. This latter motion will both stir the fuel and clear out ash at the same time.

An ash pan 47 may be positioned within the heater casing 15, under central dump grate 32, to catch any ashes or spent fuel which fall through the grate. Ash pan 47 may be of any shape so long as it is small enough to be removable through the space between grate legs 33 and through door opening 51. A pull handle or strap 48 is provided to facilitate the removal and replacement of ash pan 47. Sufficient clearance between ash pan 47 and central dump grate 32 should be allowed, so as to permit an adequate flow of air through the grate and easy removal of the pan.

The outer jacket 16 has an opening 51, provided for a door 50, through which fuel may be added, and ash and spent fuel removed. The opening 51 is defined by a horizontal bottom edge 52, a horizontal top edge 53, and a pair of vertical side edges 54. A reinforcing framework 55, conforming to the shape of opening 51, is set into the opening to add structural rigidity and to provide a frame upon which a door can be mounted. Reinforcing frame 55 is connected to jacket 16 so as to provide an airtight bond, such as by welding. The frame 55 is formed along its forward or outer edge with a flat planar outer lip or flange 55A providing a flat rectangular frame surface to engage door 50. A retaining wall or ledge 56 transversely spans the frame 55 from a level below the grate assembly 30 for an appropriate height to prevent ashes or burning fuel from falling out of the casing when the door 50 is open.

Hinges 57 mount the door 50 on the frame for opening and closing movement about a vertical hinge axis. The outer perimeter of door 50 is of a shape and size to conform to the free edges of the flange of frame 55. Heavy asbestos rope, about one-half inch (1.27 centimeters) diameter, is fixed to the inside edge of door 50 against the flange or lip 55A to provide an airtight seal between door 50 and frame lip 55A when the door is closed. A pivoted catch bar 58 cooperates with a fixed catch 58A to latch the door 50 against frame 55 when the door is closed, to ensure that the seal is airtight.

A draft inlet opening 59 is provided in the lower portion of the door 50 to be controlled by damper 60. The draft inlet opening 59 is surrounded by a circular ring 61 and the damper 60 is formed of a movable hinged plate 62 large enough to seal against the end of the inlet opening ring 61. The position of hinged plate 62 is controlled by a thermostat 70, such as a conventional bimetallic coil thermostat, coupled to the damper plate 62 by a linkage such as the depending connector 63 illustrated in the drawings. Thermostat 70 can be adjusted to open the damper at any desired temperature between two end limits. When the ambient temperature sensed by thermostat 70 is below the temperature to which the thermostat has been set, hinged damper plate 62 is pulled away from the ring 61 surrounding the draft inlet opening 59 and into the interior of the heater, increasing the combustion rate of the fire and causing the temperature to be raised. The greater the difference between the ambient temperature and the temperature set on the thermostat, the further the hinged damper plate will be pulled from the ring 61, the greater the flow of air through the damper, and the faster the fire will burn. It will be observed that the damper controls both primary and secondary air supplies. A box-like protective surround 62 mounted on the outside of door 50 has been provided as an enclosure about the thermostat and damper mechanisms. In the illustrated example, the top of the box structure 64 is perforated, as by forming it of expanded metal, and the bottom is open, to allow for the flow of air therethrough while the front and side panels are solid walls. The door may further be equipped with an airtight viewing window 65, if desired.

In one preferred example, the jacket 16 for the heater casing 15 is formed from a light sheet metal in order to provide for more rapid radiation of heat, and thus fast heating of the room served by the heater, in response to a demand for heat, and to achieve low-cost construction. If sheet metal is used to form jacket 16, it will be further appreciated that there exists a danger that the heat of the fire may weaken the side wall nearest the burning fuel. Accordingly, the lower portion of the upper fire chamber immediately above the grate structure is lined with fire brick, indicated at 66, about the grate area to preserve the jacket in the high temperature area and serve the additional function of retaining heat over a longer period of time than would an unlined sheet metal heater.

By this construction, an efficient and reliable wood-burning or coal-burning space heater is provided wherein the burning is effectively controlled thermostatically providing appropriate primary and secondary air to achieve efficient combustion and avoid extreme temperature fluctuations, and to achieve fast heat-up by reason of the high heat radiation characteristics of the unlined portions of the sheet metal jacket in the upper region of the combustion chamber. The controlled primary air avoids extreme temperature fluctuations and results in more evenly heated rooms and greater comfort, and avoids excessive consumption of wood or coal by controlling the rate of burning. The fire brick lining the grate area in the lower portions of the upper fire chamber while preserving the sheet metal jacket in the area where it is subjected to high temperatures become heated up and retain heat over a longer period than with unlined metal jacket heaters. The thermostatically controlled damper also provides controlled secondary air, which is important to maximize burning efficiency. The secondary air provides oxygen to the unburned gases in the upper portion of the chamber, which if left unburned would escape through the smoke stack outlet and be released unburned into the atmosphere. Providing secondary air to ensure burning of these gases in the upper portion of the fire chamber utilizes the heat provided by the otherwise unburned gases to further increase the overall efficiency of the heater. Because of the structural arrangement of the present heater, the secondary air is pre-heated, which is an important factor in more complete combustion. This provision for adequate secondary air is important should the primary air supply become obstructed by excessive ashes either below or above the grate. Also adequate secondary air entering the passage between the door and the grate assembly significantly reduces the risk of fire flashback caused by a sudden supply of oxygen mixing with unburned volatiles in the main fire chamber when the door is opened. The secondary air supply immediately inwardly of the door also helps maintain a lower door temperature thus reducing the danger of warpage.

Although a particular embodiment of the invention has been described and illustrated herein, it is recognized that modifications, variations, and alternate embodiments may readily occur to those skilled in the air without departing from the spirit of the invention. Thus it is intended that all such modifications and equivalents to the particular embodiment are covered by the appended claims.

What is claimed is:

1. A space heater for burning wood or coal fuel and the like, comprising a casing defining a vertically elongated heater enclosure including an outer sheet metal jacket forming vertically elongated outer side walls spanning the full height of the heater and forming a complete lateral surround about all side portions of the heater other than the door region thereof, flat top and bottom walls secured in air tight relation to the outer side walls, a grate assembly spanning the interior of the heater within the side walls at a horizontal location in the lower half of the interior of the casing spaced a predetermined distance above the bottom wall and dividing said interior into an ash chamber below the grate assembly and a fire chamber above the same, the casing having a single vertically elongated door and rectangular door frame therefor spanning the major portion of the height of the casing including the full height of the ash chamber and the major portion of the height of the fire chamber to provide access to both the ash chamber and the fire chamber, said door frame being formed of a pair of laterally spaced flat parallel vertical side frame plate members extending upwardly from the bottom wall a distance spanning the major portion of the height of the casing and including top and bottom flat horizontal frame plate members joined to the side frame plate members at the ends of the latter and joining said outer side walls along rectilinear vertical and horizontal juncture lines in outwardly extending relation therefrom with their outermost front edges lying in a single vertical plane defining a flat planiform door frame surface forming a single rectangle spaced outwardly from the path of the adjoining outer side wall portions of the casing, said door frame forming a rectangular lateral surround about the space framed thereby defining a single vertically elongated framed access passage extending through the adjacent side wall portion of the jacket and outwardly for a predetermined distance from the path of the latter and extending from immediately adjacent the bottom wall to a height considerably above the level of the grate assembly, means movably supporting said door on the door frame for movement between a closed position against the flat door frame surface in a plane spaced outwardly from the path of the adjacent side wall portion and movable to an open position and completely spanning the rectangular frame when in closed position, the single framed access passage including three inter-communicating zones spaced along the height thereof forming an upper fire chamber access zone above the level of the grate assembly spanning the major portion of the height of the fire chamber and a lower ash chamber access zone below the level of the grate assembly and an intermediate air communication zone therebetween occupying the space between the closed door and the periphery of the grate assembly when the door is closed for achieving free air flow communication between the upper and lower zone, the heater having a draft inlet opening horizontally aligned with the ash chamber for admitting controlled amounts of primary and secondary air into the ash chamber and into the fire chamber through the intermediate air communication zone, and said outer side walls being inwardly lined with fire brick along the inner surface thereof over a zone extending upwardly from the grate assembly vertically spanning about half the height of the fire chamber over the maximum heat zone therein.

2. A space heater as defined in claim 1, wherein said draft inlet opening is provided in the door of the heater, and the heater further including thermostatically controlled damper means mounted in the door for regulating exterior air inflow through the draft inlet opening in predetermined relation to departure of temperature adjacent the heater from predetermined chosen temperatures.

3. A space heater as defined in claim 2, wherein said grate assembly comprises a fuel support platform and having a circular center opening, an outer grate member supported for rotation about the axis of said platform in said circular center opening and having ash passages therethrough and a center grate opening, and a center grate member spanning said center grate opening in said outer grate member and supported on the outer grate member for rectilinear reciprocating movement along an axis paralleling a diameter of the fuel support platform, the last mentioned grate member also having ash passages therethrough.

4. A space heater as defined in claim 3, wherein said angular fuel support platform declines in a downwardly and inwardly converging conical path from the outer perimeter thereof to said circular center opening.

5. A space heater as defined in claim 4, wherein said fuel support platform includes a plurality of rigid legs connected to the platform adjacent the outer perimeter thereof to engage the bottom wall of the heater casing and support the fuel support platform at a predetermined level spaced above the bottom wall thereof.

6. A space heater as defined in claim 3, wherein said center grate opening in said outer grate member is of substantially rectangular configuration and said inner grate member is of rectangular configuration disposed in underlying relation immediately below said opening.

7. A space heater as defined in claim 6, wherein said fuel support platform includes downwardly extending offset bracket members adjacent the edge of said circular opening depending below the outer edge of the outer periphery of said outer grate member to support the latter for rotation about the axis of said fuel support member, the outer grate member having a circular outer perimeter, and said outer grate member having downwardly extending offset bracket formations engaging opposite sides of said rectangular inner grate member slidably supporting the latter for rectilinear reciprocative movement relative to the outer grate member along an axis paralleling a diameter of the fuel support platform.

8. A space heater as defined in claim 7, wherein said rectangular inner grate member has an elongated handle formation extending from an end thereof along an axis paralleling the axis of reciprocation of the inner grate member having formations on the end of the handle formation to be coupled to a handle extension insertable through said door opening for manually imparting reciprocatory movement to said inner grate member.

9. A space heater as defined in claim 5, wherein said fuel support platform includes downwardly extending offset bracket members adjacent the edge of said circular opening depending below the outer edge of the outer perimeter of said outer grate member to support the latter for rotation about the axis of said fuel support member, the outer grate member having a circular outer perimeter, and said outer grate member having downwardly extending offset bracket formations engaging opposite sides of said inner grate member slidably supporting the latter for rectilinear reciprocative movement relative to the outer grate member along an axis paralleling a diameter of the fuel support platform.

10. A space heater as defined in claim 1, wherein said door frame includes an outwardly projecting flange lip along the edge of the frame at each of the vertical side frame plate members thereof and the top and bottom frame plate members thereof defining the flat planiform door frame surface, and said door having asbestos rope on the portion of the inwardly facing surface of the door confronting and aligned with the flat planiform door frame surface formed by said flange lips to be disposed in continuous sealing contact with the latter when the door is in closed position and seal the heater casing against air leakage about the door frame.

* * * * *